United States Patent [19]

Börner

[11] Patent Number: 5,075,973

[45] Date of Patent: Dec. 31, 1991

[54] DEVICE FOR CUTTING FRUIT, VEGETABLES, OR THE LIKE INTO SLICES

[75] Inventor: Jürgen Börner, Niederkail, Fed. Rep. of Germany

[73] Assignee: A. Börner GmbH, Fed. Rep. of Germany

[21] Appl. No.: 563,100

[22] Filed: Aug. 3, 1990

[30] Foreign Application Priority Data

Aug. 5, 1989 [DE] Fed. Rep. of Germany ..... 3926104

[51] Int. Cl.[5] ..... B26B 3/03

[52] U.S. Cl. ..... 30/279.6; 83/856; 83/932; 30/287; 99/537

[58] Field of Search ..... 83/856, 857, 932, 704, 83/708, 42, 698; 99/537, 538; 30/287, 279.6, 279.2, 346.59

[56] References Cited

U.S. PATENT DOCUMENTS

| | | | |
|---|---|---|---|
| 161,920 | 4/1875 | Witmer | 83/857 |
| 2,035,111 | 3/1936 | Behrman | 30/346.59 X |
| 4,290,196 | 9/1981 | Börner | 30/278 X |

FOREIGN PATENT DOCUMENTS

| | | | |
|---|---|---|---|
| 306017A2 | 9/1988 | European Pat. Off. . | |
| 3022021C2 | 9/1984 | Fed. Rep. of Germany . | |
| 1230824 | 5/1986 | U.S.S.R. | 83/856 |

*Primary Examiner*—Douglas D. Watts
*Assistant Examiner*—Kenneth E. Peterson
*Attorney, Agent, or Firm*—Hill, Van Santen, Steadman & Simpson

[57] ABSTRACT

Device for cutting fruit, vegetables or the like into slices, comprising a blade-holding plate at whose front edge a V-shaped cutter blade is arranged, the latter being composed of two knife blades; comprising two framing ledges arranged essentially parallel that are connected to one other by the blade-holding plate and by at least one further transverse web; and comprising an introducible slide plate guided parallel to the blade-holding plate at the framing ledges, whereby a narrow gap remains between the back section of the slide plate and the cutter blade. In accord with the invention, the circumferential edge of the knife blades—at least the back region thereof adjoining the V-tip of the cutter blade—are held with form-fit by applied plastic billets in the form of a lying U-profile.

6 Claims, 2 Drawing Sheets

Fig.3
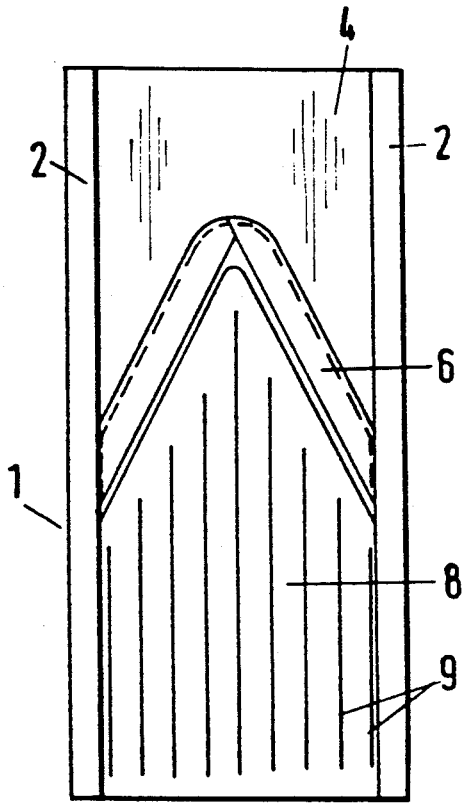
Fig.4
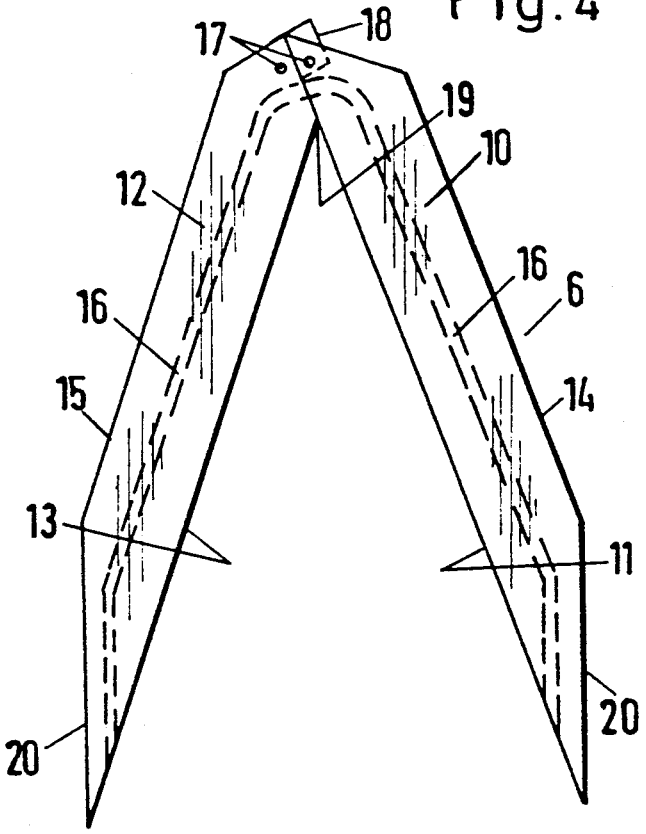
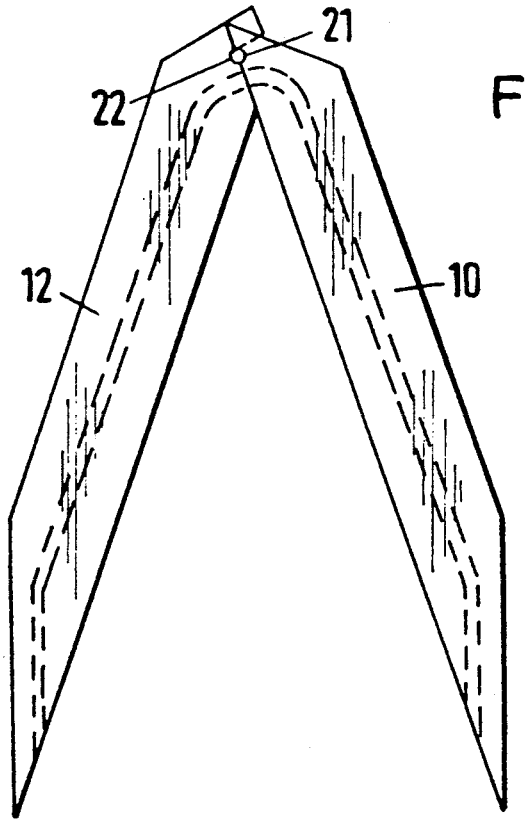
Fig.5

DEVICE FOR CUTTING FRUIT, VEGETABLES, OR THE LIKE INTO SLICES

The invention is directed to a device for cutting fruit, vegetables or the like into slices, comprising a blade-holding plate at whose leading edge a V-shaped cutter blade is arranged, the latter being composed of two knife blades; comprising two framing ledges arranged essentially parallel that are connected to one another by the blade-holding plate and by at least one further transverse web; and comprising a slide plate guided in the framing ledges and introducible parallel to the blade-holding plate, whereby a narrow gap remains between the back edge of the slide plate and the cutter blade.

Such a device is disclosed, for example, by EP 0 306 017 A2, whereby the V-shaped cutter blade employed therein, however, is fashioned of one piece, this being unfavorable particularly in fabrication-oriented terms.

Figure 1:
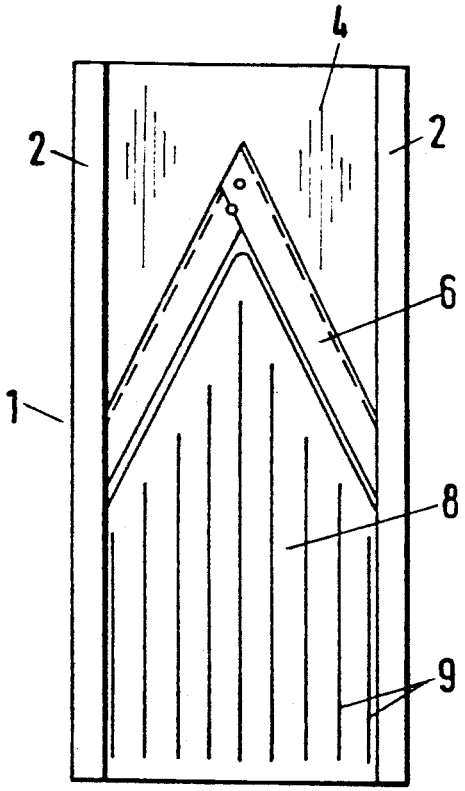
Figure 2:
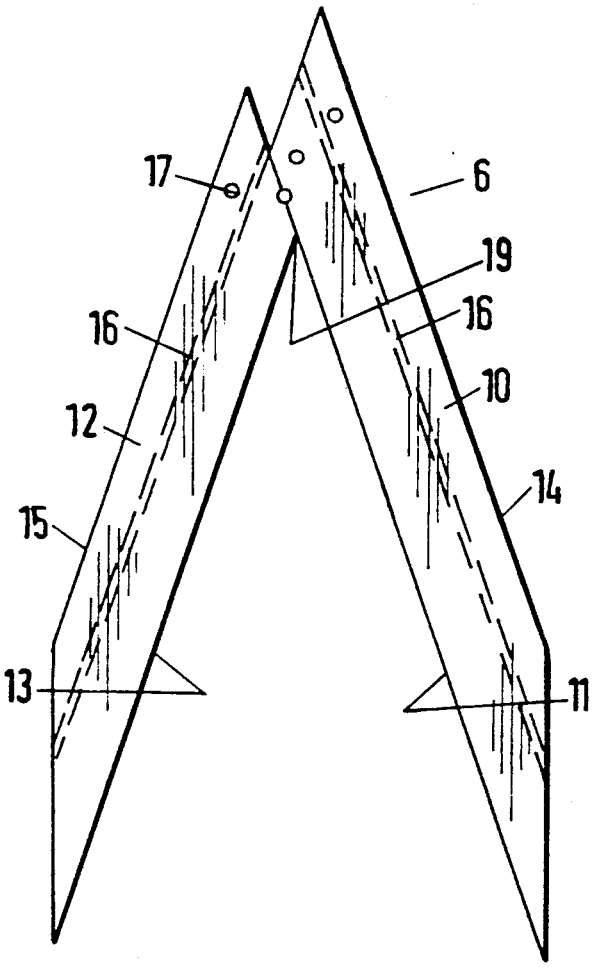

A prior art on the basis whereof the present invention departs is disclosed in the drawings with reference to FIGS. 1 and 2, whereby FIG. 1 schematically shows a device conforming to the preamble of Claim 1 of a type already distributed by the applicant for some time.

FIG. 2 shows an enlarged view of the corresponding arrangement of the knife blades in the device of FIG. 1.

As shown in FIG. 1, the known device 1 comprises two framing ledges 2 that are held together in their back part by a blade-holding plate 4 and are held together in their front part by two transverse webs that are arranged at the underside of the device 1 and are not shown in the drawing. A slide plate 8 introducible parallel to the blade-holding plate 4 is arranged in the front part of the device 1, this slide plate 8 being guided in a lateral groove in the framing ledge 2 and being arranged such in its engaged condition that a narrow gap remains between the back section of the slide plate 8 and a cutter blade 6 that is secured to the front edge of the blade-holding plate 4. The slide plate 8 on which the material to be cut is guided additionally comprises longitudinal fluting 9 provided for this purpose.

FIG. 2 shows the arrangement of knife blades 10 and 12 of the cutter blade 6 of the known device 1 in an enlarged illustration. The broken lines thereby respectively indicate a profiled step 16 of the knife blades 10 and 12, whereby the regions of the knife blades 10 and 12 lying toward the cutting edges 11 and 13 lie higher than the regions adjoining the circumferential edges 14 and 15. The profiled steps 16 are thereby normally composed of bevelings, whereby the regions of the knife blades joined by these bevelings proceed parallel to one another.

In the known device, a V-point 19 of the cutter blade 6 is formed in that the two knife blades 12 and 13 abut flush, whereby their retention in the blade-holding plate 4 ensues with rivet-like plastic nubs that penetrate corresponding bores 17 of the two knife blades 10 and 12. The plastic nubs are produced in an injection molding process.

The known device is disadvantageous insofar as it is extremely difficult to hold the two knife blades precisely on one cutting plane, so that a lift-up of the knife blades is inescapable when certain cutting forces are exceeded, when cutting relatively hard articles. A corresponding dislocation of the two knife blades relative to one another then becomes more and more pronounced over the course of time and ultimately leads thereto that the entire device becomes unusable.

It is therefore the object of the present invention to improve the known device to such effect that a reliable retention of the knife blades is guaranteed in order to thus improve the functionability and service life of the device overall.

This object is inventively achieved in that the circumferential edge of the knife blades—at least the back region thereof adjoining the V-point of the cutter blade—is held with form-fit by applied plastic billets in the form of a lying U-profile. The lift-up of the blades that was hitherto unavoidable over the long-term and the misalignments in the common cutting plane that arise therefrom can be reliably avoided on the basis of this design of the retention of the knife blades in the blade-holding plate.

In a specific embodiment of the invention, the applied plastic billets merge completely into the plastic compound of the blade-holding plate and simultaneously penetrate the back region of the knife blades at at least one location. It is thereby especially preferred that either at least one separate bore is provided or respectively one edge recess is provided in the back region of each and every knife blade, whereby the edge recesses together constitute the form of a single, oblong bore after the knife blades are assembled to form the cutter blade. The plastic billets thus prevent both a widening of the U-profile and, thus, a loosening of the form-fit and, over and above this, also additionally guarantee an exact securing of the knife blades to counter dislocation in the plane of the cutting surface.

Another embodiment of the invention proposes that the knife blades are arranged such that at least one projection of the one knife blade lies at least partially under the other knife blade, whereby said projection is bent off, beveled relative to the main part of the one knife blade or is fashioned as a step or formed in a similar way. This measure of the invention additionally, effectively opposes a spreading of the knife blades in the region of the point of the knife, whereby the corresponding bent-off, step formation or beveling of the downwardly lying knife blade guarantees that the cutting surfaces of the knife blades in fact lie exactly in one plane and also reliably remain there.

The invention further provides that the knife blades comprise a profile having a step that is rounded off such at the back region of the knife blades adjoining the point of the knife that a nearly semicircular profile guidance derives when the knife blades are assembled. This special design of the back region of the knife blades enables an especially firm holding thereof by the applied plastic billets in the especially sensitive region of the V-tip of the cutter blade since the overall circumferential edge can be embraced with form-fit.

The invention thus makes a device of the species available whose knife blades are held especially reliably and firmly in the blade-holding plate and whereby it is assured even given high mechanical and thermal stressings that the cutting surfaces of the knife blades reliably remain in one plane. It should be additionally noted that the injection molding techniques employed in the invention are especially easy to manage since no core puller for ejection is required.

Further advantages and features of the invention derive from the following exemplary embodiment that is set forth with reference to the attached drawings. Thereby shown are:

FIG. 3—the device of the invention in a schematic view;

FIG. 4—the arrangement and design of the knife blades of the invention in an enlarged illustration; and FIG. 5 another design of the knife blades of the invention.

FIG. 3 shows an illustration similar to FIG. 1. A critical difference between the inventive device of FIG. 3 and the device of the prior art conforming to FIG. 1 is comprised in the different guidance of the step profile that is indicated in both drawings with the broken lines on the knife blades. In the device of the prior art, these profile steps proceed on a straight line from one end of the knife blade to the other. In the device of the invention, the respective profile ends at a front lateral edge of the knife blade in front of the framing ledge, whereas it runs out into a rounded portion at the other end, so that a nearly semi-circular run-out of the step profile at the upper end of the V-shaped blade 6 derives when the knife blades are assembled.

The course of this profile can be seen particularly clearly again in the enlarged illustration of FIG. 4. The profile steps 16 here and shortly before they reach the lateral edges 20 of the knife blades 10 and 12, whereby those regions of the knife blades facing toward the cutting edges 11 and 13 lie higher than the regions thereof facing toward the circumferential edge 14, 15. As a result thereof, the sensitive V-point 19 of the blade 6 is relieved of thrust forces in the cutting surface since the front lateral edges 20 of the knife blades 10, 12 that are not penetrated by the profile steps 16 can now shift freely in the corresponding slots in the framing ledges 2. The occurrence of thrust forces given temperature fluctuations, initially in ejection but later during cleaning with hot water, etc., is thereby reliably avoided, since the profile-free edges 20 make a thermal compensation possible given contractions of plastic and metal. The from-fit holding of the knife blades 10 and 12 of the cutter blade 6 ensues in the indicated way at least in the region of the V-point 19 of the cutter blade 6. A projection 18 of the left-hand knife blade 12 is thereby provided in this region, this being bent off, beveled relative to the main part of the knife blade 12 or being fashioned as a step, so that it comes to lie under that section of the right-hand knife blade 10 located there. For further improving the hold in this region, at least two bores 17 are provided, whereof respectively one is arranged in one of the two knife blades 10 and 12. The plastic billets that are applied form-fitted overlap at least this region or the knife blades with positive lock from both sides and thereby simultaneously engage through the bores 17.

As shown in FIG. 5, edge recesses 21, 22 can also be alternatively provided in each knife blade 10, 12, these edge recesses 21, 22 together assuming the shape of a single oblong bore which can then be penetrated by the plastic carriers.

Both individual as well as in arbitrary combinations, the features of the invention disclosed in the above specification, in the drawings as well as in the claims can be critical for the realization of the various embodiments of the invention.

I claim:

1. Device for cutting fruit, vegetables or the like into slices, comprising a blade-holding plate at whose front edge a V-shaped cutter blade is arranged, the cutter blade being composed of two knife blades; comprising two framing ledges arranged essentially parallel that are connected to one another by the blade-holding plate and by at least one further transverse web; and comprising a slide plate guided at the framing ledges and introducible parallel to the blade-holding plate, whereby a narrow gap remains between the slide plate and the cutter blade, characterized in that the knife blades (10, 12) form a V-pointed cutting edge and have outer edges which form fit at least partially into the front edge of the blade holding plate, said blade holding plate front edge and said knife blades forming a U-shaped interface.

2. Device according to claim 1, characterized in that the applied plastic billets merge completely into the blade-holding plate (4) and simultaneously penetrate the back region of the knife blades (10, 12) at at least one location.

3. Device according to claim 2, characterized in that at least one separate bore (17) is provided in the back region of each knife blade (10, 12).

4. Device according to claim 2, characterized in that a respective edge recess (21, 22) is provided in the back region of each knife blade (10, 12), whereby, after the assembly of the knife blades to form the cutter blade (6), the edge recesses together have the shape of a single oblong bore.

5. Device according to one of the preceding claims, characterized in that the knife blades (10, 12) are arranged such that at least one projection (18) of the one knife blade (12) lies at least partially under the other knife blade (10), whereby said projection (18) is bent off, beveled relative to a main part of the one knife blade (12), is fashioned as a step or is shaped in a similar way.

6. Device according to one of claims 1–4 characterized in that the knife blades (10, 12) comprise a profile having a step (16) that is rounded off such in the back region of the knife blades (10, 12) adjoining the point (19) of the cutter that, when the knife blades (10, 12) are assembled, a nearly semi-circular profile guide derives.

* * * * *